United States Patent [19]

Willat

[11] 4,305,327

[45] Dec. 15, 1981

[54] PRESSURIZED GAS ENGINE

[76] Inventor: Arnold F. Willat, 238 D. St., San Rafael, Calif. 94901

[21] Appl. No.: 102,922

[22] Filed: Dec. 12, 1979

[51] Int. Cl.[3] ..... F01B 21/02; F01L 15/16; F01B 19/00

[52] U.S. Cl. ..... 91/183; 91/271; 92/64; 92/73; 92/90

[58] Field of Search ..... 91/183, 188, 180, 271, 91/265; 92/89, 90, 91, 92, 64, 73, 72

[56] References Cited

U.S. PATENT DOCUMENTS

| | | | |
|---|---|---|---|
| 2,372,813 | 4/1945 | Darling | 92/91 |
| 3,229,590 | 1/1966 | Huska | 92/92 |
| 3,854,383 | 12/1974 | Paynter | 91/180 |
| 3,946,641 | 3/1976 | Hirmann | 92/92 |
| 4,104,955 | 8/1978 | Murphy | 91/188 |

*Primary Examiner*—Paul E. Maslousky
*Attorney, Agent, or Firm*—Flehr, Hohbach, Test, Albritton & Herbert

[57] ABSTRACT

An engine is provided which converts pressurized gas into useful mechanical energy. The engine uses pressurized gas in such a way to avoid contact between the gas and sliding metal parts. As such, the engine is particularly adapted for use with naturally pressurized geothermal gases which may contain substances harmful to metal. In the preferred form, the engine includes a plurality of reciprocating plungers which serve as energy transfer means. Deformable enclosures such as spheroidal hollow balls made of an elastomer material are positioned on opposite sides of each plunger along its axis of movement. The deformable enclosures exert a force against the plungers to move the plungers when filled with pressurized gas. Each plunger alternately collapses each of the deformable enclosures as it reciprocates. A valve system for controlling the ingress and egress of pressurized gas to the deformable enclosures is responsive to the motion of the plungers. With the valves operating in a predetermined repetitive sequence, pressurized gas is directed to impart cyclical motion to the plungers which can be harnesses to perform useful work.

26 Claims, 4 Drawing Figures

PRESSURIZED GAS ENGINE

BACKGROUND OF THE INVENTION

The invention relates generally to engines of the type which are powered by pressurized gases and which convert gas pressure into mechanical energy.

In developing new sources of energy for replacing increasingly scarce and expensive fossil fuels, greater attention is being directed to the harnessing of naturally occurring pressurized gases from geothermal sources. Geothermal gases occur in great abundance in certain locations throughout the world and such gases contain potentially valuable energy which is usually wasted. One problem in harnassing geothermal gases is their generally caustic nature which causes destruction of metal parts such as cylinders and pistons. Geothermal gases also tend to have an unpleasant odor and may even be toxic, which makes any leakage from devices or systems which employ such gases highly undesirable. It is therefore necessary, when seeking a means for harnassing geothermal gases, to eliminate to the extent possible all potential leaks and any possible contact between the gases and metal parts. Because geothermal gases are potentially volatile, it is also important to avoid sources of sparks and to minimize friction in any machine which harnasses geothermal gases. The harnassing of naturally occurring pressurized gases can become an important energy resource for the future, offering a steady source of energy far more reliable than alternative energy sources such as solar or wind power.

OBJECTS AND SUMMARY OF THE INVENTION

It is a general object of the present invention to provide a pressurized gas engine which produces useful mechanical motion by harnassing the energy contained in a pressurized gas.

Another object of the invention is to provide a pressurized gas engine which avoids any contact between the gas employed and sliding metal parts.

Another object of the invention is to provide a pressurized gas engine which is simple to maintain and repair.

Accordingly, the present invention provides a pressurized gas engine comprising energy transfer means supported for movement in response to forces exerted against the energy transfer means. A plurality of deformable enclosures are positioned adjacent the energy transfer means. Each deformable enclosure expands against and moves the energy transfer means when filled with pressurized gas. The deformable enclosures are arranged to move the energy transfer means in different directions such that the expansion of one of the deformable enclosures will cause the energy transfer means to move against and collapse another of the deformable enclosures. Each of the deformable enclosures includes a gas conduit connected thereto for ingress and egress of gas. In addition, valve means are provided for controlling gas flow through each of the gas conduits. A control means for the valve means responds to the position of the energy transfer means and serves to admit pressurized gas to selected ones of the deformable enclosures and simultaneously allows for escape of gas from other selected ones deformable enclosures in a predetermined repetitive sequence whereby pressurized gas is directed to impart cyclical motion to the energy transfer means.

DESCRIPTION OF THE PREFERRED EMBODIMENT

Figure 1:
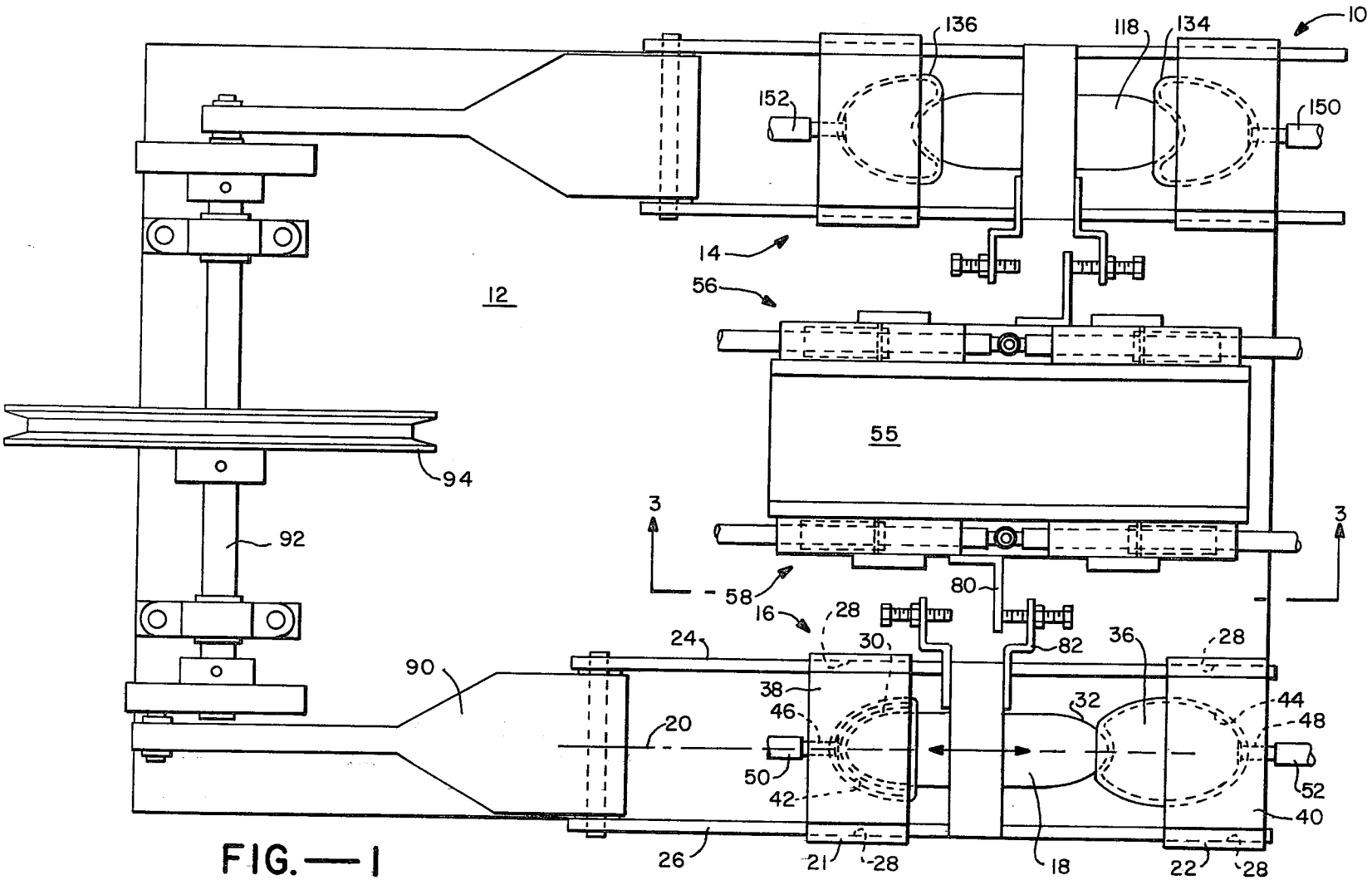
FIG. 1 is a top plan view of a pressurized gas engine incorporating the preferred embodiment of the present invention.
Figure 2:
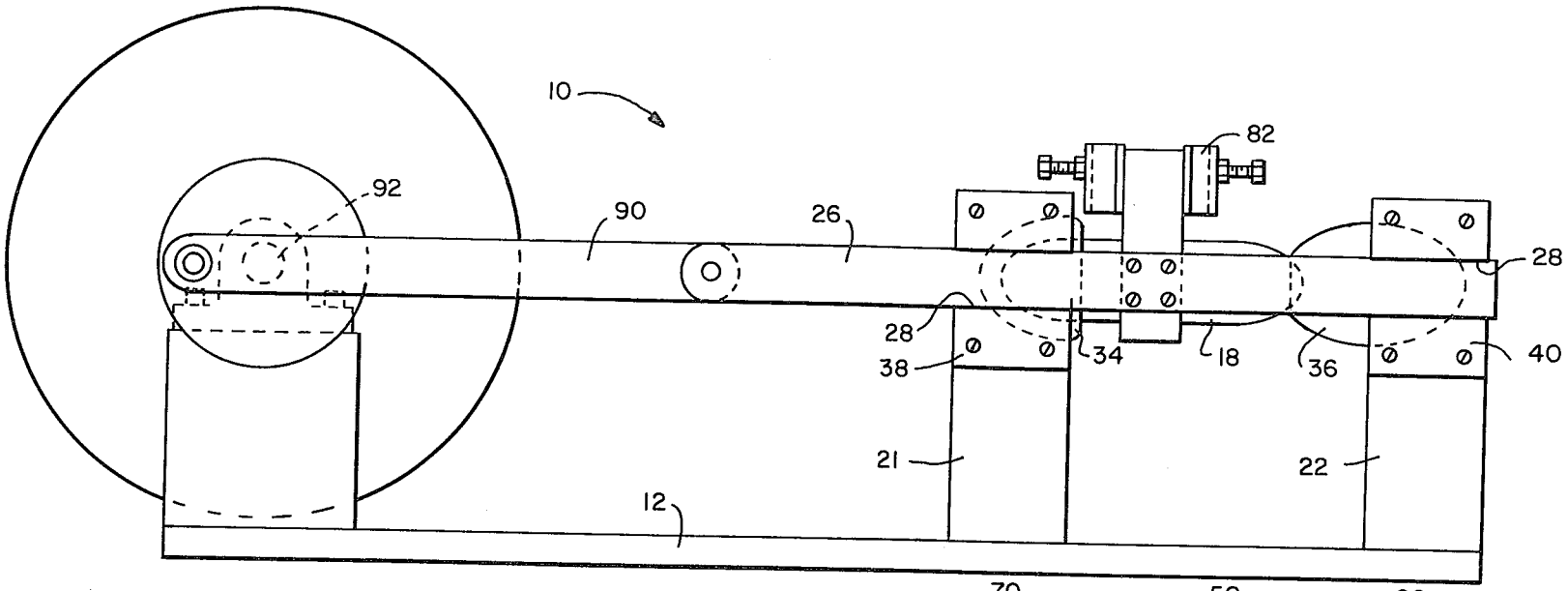
FIG. 2 is a side elevational view of the pressurized gas engine shown in FIG. 1.

Referring to FIGS. 1 and 2, a pressurized gas engine 10 in accordance with the present invention is shown, having a base 12 on which the elements of the engine are mounted. Along each side of the base are a pair of actuator assemblies 14 and 16. The actuator assemblies are constructed generally in accordance with the teaching of patent application Ser. No. 069,381, filed Aug. 24, 1979, by the same inventor as the present application. For the purposes of the detailed description, only actuator assembly 16 will be described, although it should be understood that the elements found in actuator assembly 16 will also be found in actuator assembly 14.

Actuator assembly 16 includes a double ended plunger 18 which serves as an energy transfer means. Plunger 18 is supported for movement along an axis of movement 20 by a pair of support members 21 and 22. Actuating rods 24 and 26 connected to plunger 18 are movable within slots 28 provided in supports 21 and 22. In FIGS. 1 and 2, plunger 18 is shown in its left-most position. The opposite ends of plunger 17 are in the form of generally convex spheroidal engaging portions 30 and 32, the purpose of which will be described below.

Adjacent each end of plunger 18 along axis of movement 20 are deformable enclosures 34 and 36. The deformable enclosures are generally spheroidal hollow balls formed of an elastomer material which should be impervious to the type of gas used to power the engine. The deformable enclosures have predetermined shapes and interior volumes when undistorted and, as shown, are substantially egg-shaped in the preferred embodiment. Deformable enclosures 34 and 36 are each supported in a nesting support 38 and 40, respectively. The nesting supports each have a concave generally spheroidal surface 42 and 44 in which the respective deformable enclosures 34 and 36 are positioned. The conforming shapes of the deformable enclosures and the nesting supports provides support over a substantial peripheral portion of the deformable enclosures.

Centrally disposed in the concave support surfaces 42 and 44, along axis of movement 20, are passageways 46 and 48, respectively. Each deformable enclosure includes a gas conduit for ingress and egress of gas. In the preferred embodiment deformable enclosures 34 and 36 are provided with fittings which extend through passageways 46 and 48, with a length of conduit material being connected to the fittings. For deformable enclosure 34, the gas conduit formed by the fitting and conduit material is designated 50 and for deformable enclosure 36, the gas conduit formed by the fitting and conduit material is designated 52.

Figure 3:
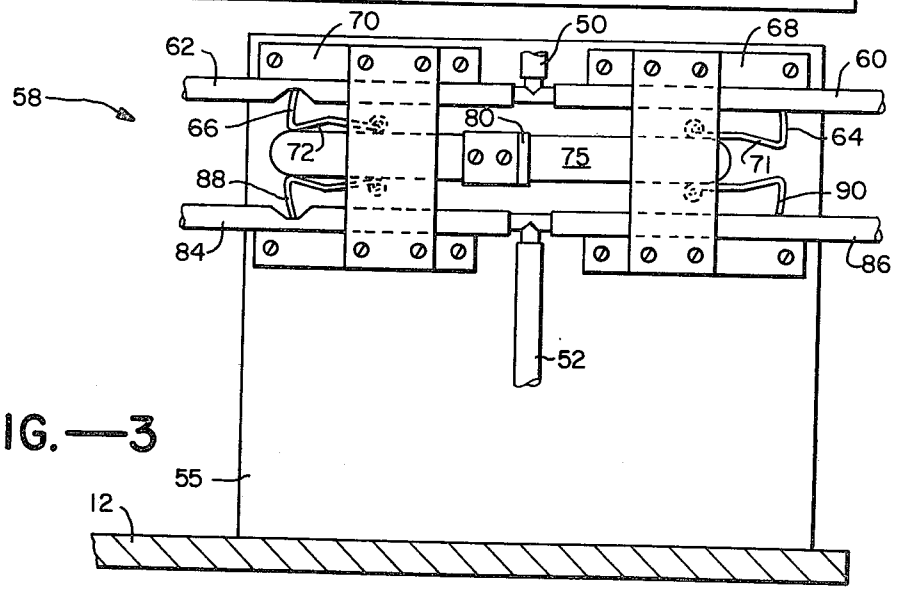
FIG. 3 is a side elevational view taken along line 3—3 of FIG. 1 showing one of the valve assemblies of the pressurized gas engine.

To control the ingress and egress of gas to deformable enclosures 34 and 36, a system of valves is provided on base 12. Separate valve assemblies for actuators 14 and 16 are mounted on a support 55 on base 12. Valve assembly 56 is associated with the plunger of actuator 14 and valve assembly 58 is associated with plunger 18 of actuator 16. FIG. 3 provides a side view of valve assembly 58 and FIG. 4 illustrates the various tubing connections required.

Figure 4:
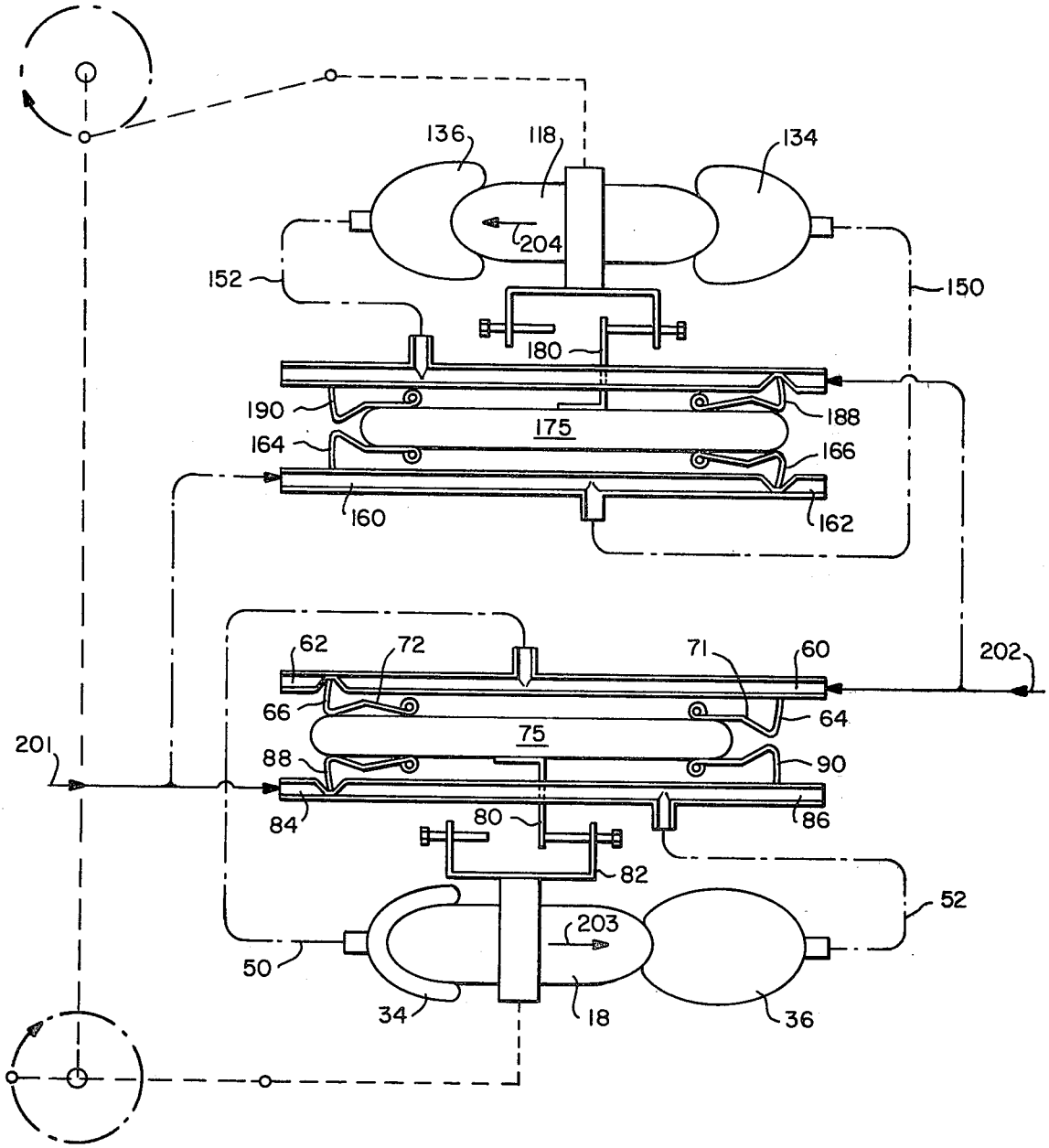
FIG. 4 is a schematic diagram illustrating the operation of the valve control system of the pressurized gas engine shown in FIG. 1.

The tubing and valves shown in FIGS. 1, 3 and 4 control the ingress and egress of pressurized gas to deformable enclosures 34 and 36. As noted above, each deformable enclosure has a single gas conduit line for ingress and egress of gas. Conduit 50 for deformable enclosure 34 connects a pair of branch conduits 60 and 62, shown in FIGS. 3 and 4. The branch conduits include a supply tube 60 for connection to a source of pressurized gas and a vent tube 62 for allowing escape of gas from conduit 50 and the deformable enclosure. Both branch conduits 60 and 62 include segments of flexible tubing material, and conduit 50 can also be formed of flexible tubing material if desired.

The valves used in the engine are constructed in accordance with the teaching of application Ser. No. 028,526, filed Apr. 9, 1979, now U.S. Pat. No. 4,262,876 by the same inventor as the present application. A separate valve is provided in each branch conduit 60 and 62. The first valve includes a first compression member 64 for exerting a force against the supply tube 60 and the second valve which operates as a release valve includes a second compression 66 member for exerting a force against vent tube 62. Compression members 64 and 66 are oriented substantially perpendicular to the flow axis of the flexible tubing segments in branch conduits 60 and 62. The flexible tubing segments are each located adjacent a suitable rigid base member 68 and 70 (see FIG. 3) so that compression members 64 and 66 will squeeze the flexible tubing material against the base members and cut off fluid flow through the tubing. The compression members 64 and 66 are attached to pivotally supported arms 71 and 72, respectively, which permit independent rotation of the compression members into substantially perpendicular orientation with respect to the flow axis of the flexible tubing. The flexible tubing segments are oriented generally parallel with the axis of movement 20 of the plunger. Control means for operating the valves includes cam member 75 supported for movement generally parallel with the reciprocating movement of plunger 18. This allows cam member 75 to be operated by the movement of the plunger 18 associated with the cam in response to the position of the plunger. In the preferred embodiment, an arm 80 extending outwardly from cam 75 and a bracket 82 extending outwardly from plunger 18 serves as a lost motion linkage for operating cam 75. The lost motion linkage allows the cam to operate the valves at the proper time to cause reciprocation of plunger 18. As shown, bracket 82 is adjustable to insure that the cam operates compression members 64 and 66 at the optimal time depending on the gas pressure available and the speed of the engine.

The gas conduit connections and valves for controlling the ingress and egress of gas to deformable enclosure 36 are essentially the same as for deformable enclosure 34. Referring to FIGS. 1, 3 and 4, gas conduit 52 is connected to the lower pair of branch conduits 84 and 86 in valve assembly 58. The supply tube 84 and vent tube 86 contain segments of flexible tubing material. A pair of valves which include first and second compression members 88 and 90, respectively control whether gas is entering or being vented from deformable enclosure 36 by way of gas conduit 52. The construction and operation of the valves incorporating compression members 88 and 90 are exactly the same as for the valves incorporating compression member 64 and 66 described above. Cam 75 also serves to operate the lower valves. It should be noted, however, that the position of the supply and vent branch conduits in the lower set of valves is reversed, supply tube 84 being on the left side whereas supply tube 60 is on the right side in the figures. Consequently, when cam 75 is in the left-most position, the supply tube carrying pressurized gas to deformable enclosure 34 through gas conduit 50 is open, whereas the supply tube 84 carrying gas to deformable enclosure 36 through gas conduit 52 is closed. Thus, one deformable enclosure is being vented while the other is being filled with pressurized gas.

The actuating rods 24 and 26 connected to plunger 18 are coupled to a crank arm 90 which is used to drive a suitable rotating shaft 92 or other dynamic means for performing work. A belt pulley 94 or other suitable means for driving machinery or the like is connected to rotating shaft 92 to provide the energy output of engine 10.

The components of actuator 14 and associated valve assembly 56 are the same as for actuator 16 and valve assembly 58 described above. Hereinafter, when referring to elements of actuator 14 and valve assembly 56, reference numbers will be used between 100 and 199. Elements of actuator 14 and valve assembly 56 will be designated by numbers having the same last two digits as the reference numbers of equivalent elements in actuator 16 and valve assembly 58.

Referring to FIGS. 1 and 4, the position of plunger 118 and associated actuating rods 124 and 126 is slightly different from elements 18, 24 and 26. The difference allows crank arms 90 and 190 to be connected to rotating shaft 92 at different angular positions with respect to the rotational axis of the shaft. In the preferred embodiment, the crank arms are 90° out of phase.

Operation of the pressurized gas engine of the present invention will be described with reference to FIGS. 1 and 4. The source of power for the engine is pressurized gas from any suitable source, such as a geothermal gas supply. Referring to FIG. 4, the pressurized gas is supplied by any suitable means to tubing shown schematically at 201 and 202. The pressure of the gas supplied will determine the horsepower output of the engine, with pressures as low as 10 psi being suitable to operate small scale versions of the engine having deformable enclosures of approximately six inches in diameter. By means of suitable conduits, the gas supply from points 201 and 202 are delivered to supply tubes 60, 84, 160 and 184. There is no connection necessary to vent tubes 62, 86, 162 and 186 unless it is desired that the vented gases be carried away from the vicinity of the engine, in which case a suitable exhaust system can be connected to those vent tubes.

Assuming the various elements of the engine are in the positions shown in FIGS. 1 and 4, compressed gas will be supplied first to deformable enclosures 34 and 134. This occurs because compression members 64 and 164 are in the open position and compression members 88 and 188 are in the closed position. As such, the only paths open for the compressed gas are from point 202 through supply tube 60 to gas conduit 50 and deformable enclosure 34, and from point 201 through supply tube 160 and gas conduit 150 to deformable enclosure 134. The pressurized gas will cause deformable enclosures 34 and 134 to expand against plungers 18 and 118, respectively, moving the plungers. Plunger 18 will move in the direction of arrow 203 and plunger 118 will move in the direction of arrow 204.

As plunger 18 moves, it will begin to collapse opposite deformable enclosure 36. Plunger 118 is shown approximately midway through the cycle just beginning with plunger 18, and deformable enclosure 136 is shown partially collapsed by the movement of plunger 118. Because compression members 90 and 190 are in the open position, deformable enclosures 36 and 136 are being continuously vented through their respective gas conduits 56 and 156. Eventually, deformable enclosure 36 will be collapsed inward upon itself to the same extent as deformable enclosure 34 is in FIGS. 1 and 4.

As plunger 18 moves in the direction of arrow 203, bracket 82 will eventually engage arm 80 of associated cam 75 and begin moving the cam in the same direction as the plunger. Movement of the cam will cause compression members 66 and 88 to move to their open position and will move compression members 64 and 90 to their closed position, reversing the positions of the valves. The reversal will take place only when plunger 18 has moved substantially all the way to the limit of its travel and deformable enclosure 36 is collapsed. When in that position, deformable enclosure 36 will begin receiving pressurized gas through supply tube 84 and gas conduit 56, and deformable enclosure 34 will be vented to allow escape of gas by way of gas conduit 50 and vent tube 62. The engine thus admits pressurized gas into whichever of the deformable enclosures is collapsed and vents whichever of the deformable enclosures is being collapsed by the plunger in a predetermined repetitive sequence. Assuming a steady supply of pressurized gas, the reciprocation of plunger 18 will continue indefinitely.

Actuator 14 and valve assembly 56 operate in exactly the same manner as described above, with plunger 118 operating associated cam 175 and being continuously reciprocated by the valve assembly, which supplies pressurized gas to whichever of the deformable enclosures is collapsed. Because the crank arms connected to plungers 18 and 118 are coupled to a common rotating shaft 92 at different angular positions, each plunger will tend to help drive the other through their respective cycles. Because there are four deformable enclosures in the engine of the preferred embodiment, four separate impulses are provided to rotating shaft 92 during each revolution. Thus, a relatively continuous and steady source of power is provided which can be harnasses to do useful work.

The engine efficiently uses the supply of pressurized gas because the conforming shapes of the engaging portions 30 and 32 of the plunger and the shapes of the deformable enclosures and the nesting supports allow for an absolute minimum interior volume for the deformable enclosures when collapsed. Only a single gas conduit is connected to each of the deformable enclosures, making them relatively simple to make and replace. Because the engine employs no sliding parts which are in contact with the pressurized gas, the engine is highly suitable for use with caustic gases such as geothermal gases. The parts subject to wear, primarily the deformable enclosures, are easily replaced, making the engine easy to maintain. Given sufficient gas pressure, the device will produce a significant amount of torque without the need for reduction gears.

Although the engine is shown having two actuator-plungers and a total of four deformable enclosures, it will be readily appreciated that additional actuators and plungers can be added to provide additional impulse to the rotating shaft 92. Other modifications will also be apparent to those skilled in the art. For example, the reciprocating motion of the plungers need not be linear, but may also be arcuate if an actuator mounted on a pivot arm is used. An actuator which moves along an arcuate axis of movement which would be suitable for use with the present invention is shown in FIG. 4 of application Ser. No. 069,381. It should also be understood that additional numbers of deformable enclosures could be provided on opposite sides of each plunger in the engine, if desired. An elongated plunger could be provided with several deformable enclosures on each side, all of which would act in essentially the same way as the single deformable enclosure on each side of each plunger in the preferred embodiment.

Other configurations of energy transfer means similar to plungers 18 and 118 but having different shapes and paths of movement could also be conceived. In order that the engine be able to run continuously, it is important that the energy transfer means used be supported for movement in response to forces exerted against its sides. The energy transfer means should also have a plurality of deformable enclosures positioned adjacent its sides and arranged so that the energy transfer means is moved in different directions by the expansion of the deformable enclosures. In addition, the expansion of selected ones of the deformable enclosures should cause the energy transfer means to move against and collapse other deformable enclosures. As such, numerous configurations of deformable enclosures and energy transfer devices could be conceived within the scope of the present invention.

The present invention provides a pressurized gas engine which outputs useful mechanical motion by harnassing the energy contained in a pressurized gas. The pressurized gas engine is constructed to avoid any contact between the gas employed and sliding metal parts. In addition, the pressurized gas engine is simple to maintain and repair.

What is claimed is:

1. A pressurized gas engine comprising: energy transfer means supported for movement in response to forces exerted against said energy transfer means, a plurality of deformable enclosures positioned adjacent to a said energy transfer means each said deformable enclosure expanding against and moving said energy transfer means when filled with pressurized gas, said deformable enclosures being arranged to move said energy transfer means in different directions such that the expansion of one of said deformable enclosures will cause said energy transfer means to move against and collapse another of said deformable enclosures, each said deformable enclosure including a gas conduit connected thereto for ingress and egress of gas, valve means for controlling gas flow through each said gas conduit, and control means for said valve means responsive to the position of said energy transfer means for admitting pressurized gas into selected ones of said deformable enclosures and for simultaneously allowing escape of gas from other selected ones of said deformable enclosures in a predetermined repetitive sequence wherein each of said gas conduits includes a supply tube for connection to a source of pressurized gas which incorporates a length of flexible tubing, said valve means including a first compression member for exerting a force against the flexible tubing of said supply tube substantially perpendicular to the flow axis of the flexible tubing to squeeze flexible tubing and cut off fluid flow therethrough when said first compression member is moved to be closed position by said control means whereby pressurized gas is directed to impart cyclical motion to said energy transfer means.

2. A pressurized gas engine as in claim 1 in which said deformable enclosures include elastomer enclosures having a predetermined generally spheroidal shape when undistorted.

3. A pressurized gas engine as in claim 2 including a nesting support for each said deformable enclosure, each said nesting support having a concave generally spheroidal surface for supporting said deformable enclosure over a substantial peripheral portion thereof.

4. A pressurized gas engine as in claim 3 in which said energy transfer means is provided with a plurality of generally convex engaging portions for engaging said plurality of deformable enclosures, each said engaging portion serving to collapse a deformable enclosure inward upon itself into said nesting support when said energy transfer means is moved against said deformable enclosure.

5. A pressurized gas engine as in claim 3 in which each said nesting support includes a passageway centrally disposed in said concave generally spheroidal surface, and in which said gas conduit connected to each said deformable enclosure extends through said passageway.

6. A pressurized gas engine as in claim 1 in which said first compression member is attached to a pivotally supported arm which permits rotation of said first compression member into a substantially perpendicular orientation with respect to the flow axis of said flexible tubing, said control means including a cam member movable generally parallel with the flow axis of said flexible tubing, said cam member contacting and wedging against said first compression member to force said first compression member against said flexible tubing.

7. A pressurized gas engine as in claim 6 in which said gas conduit connected to each said deformable enclosure is provided with a release valve for controlling the escape of gas from said deformable enclosure by way of said gas conduit, said release valve being opened to allow escape of gas only when said supply tube is closed by said first compression member and being closed to prevent escape of gas only when said supply tube is open to admit pressurized gas into said deformable enclosure by said first compression member.

8. A pressurized gas engine as in claim 7 in which said release valve includes a vent tube having a length of flexible tubing branching from said gas conduit and a second compression member for exerting a force against the flexible tubing substantially perpendicular to the flow axis of said vent tube to close said release valve.

9. A pressurized gas engine as in claim 8 in which said second compression member is attached to a pivotally supported arm which permits rotation of said second compression member into a substantially perpendicular orientation with respect to the flow axis of said vent tube, said cam member being movable generally parallel with the flow axis of said flexible tubing of both said supply tube and said vent tube and alternately contacting and wedging against said first and second cam members to force said first and second cam members against the flexible tubing.

10. A pressurized gas engine as in claim 9 in which said cam member is operated by the motion of said energy transfer means.

11. A pressurized gas engine as in claim 1 including a plurality of said energy transfer means mechanically connected to dynamic means for performing work, each said energy transfer means having said plurality of deformable enclosures positioned adjacent thereto.

12. A pressurized gas engine as in claim 11 including a plurality of said control means, each said control means being associated with one said energy transfer means and responding to the position thereof to control the ingress and egress of gas to said deformable enclosures to impart cyclical motion to said energy transfer means.

13. A pressurized gas engine as in claim 1 in which said energy transfer means is supported for reciprocating movement along an axis of movement, said deformable enclosures being positioned on opposite sides of said energy transfer means along said axis of movement.

14. A pressurized gas engine as in claim 13 including a crank arm connected to said energy transfer means, and a rotating member driven by said crank arm.

15. A pressurized gas engine as in claim 14 including a plurality of said energy transfer means each supported for reciprocating movement along axis of movement, each said energy transfer means being connected to said rotating member by a crank arm, said crank arms being being connected at different angular positions with respect to the rotational axis of said rotating member.

16. A pressurized gas engine comprising: a plurality of transfer means supported for reciprocating movement each along an axis of movement, a pair of deformable enclosures associated with each said energy transfer means, said deformable enclosures associated with each said energy transfer means, said deformable enclosures being positioned adjacent opposite sides of the associated energy transfer means, each said deformable enclosure expanding against and moving said energy transfer means when filled with pressurized gas each said energy transfer means alternately moving against and collapsing one of said pair of deformable enclosures as said energy transfer means is reciprocated, each said deformable enclosure including a gas conduit connected thereto for ingress and egress of gas, valve means for controlling gas flow through each said gas conduit, and a plurality of control means for said valve means, each said control means being associated with one of said energy transfer means for admitting pressurized gas to whichever of the deformable enclosures have been collapsed by said energy transfer means and for allowing escape of gas from whichever of the deformable enclosures are being collapsed by said energy transfer means wherein each said gas conduit for each said deformable enclosure is connected to a pair of branch conduits which each include segments of flexible tubing material, including a supply tube for connection to a source of pressurized gas and a vent tube for allowing escape of gas from said deformable enclosure by way of said gas conduit, wherein said valve mean associated with each said energy transfer means includes first and second compression members controlling the flow of gas through the segments of flexible tubing material in each said branch conduit, said first compression member exerting a force against said supply tubing and said second compression member exerting a force against said vent tubing, said first and second compression members being oriented substantially perpendicular to the flow axis of the segments of flexible tubing material to squeeze the flexible tubing material and cut off fluid flow therethrough, said first and second compression members being operated alternately by said control means whereby the pressurized gas is directed to impart reciprocating motion to said energy transfer means.

17. A pressurized gas engine as in claim 16 in which said first and second compression members are each attached to pivotally supported arms which permit independent rotation of said first and second compression members into substantially perpendicular orientation with respect to the flow axis of the flexible tubing, said control means including a cam member for alternately contacting the wedging against said first and second compression members to force either one of said first and second compression members against the flexible tubing.

18. A pressurized gas engine as in claim 17 in which said lengths of flexible tubing in said supply tube and said vent tube are both oriented generally parallel with said axis of movement of said energy transfer means, said cam member being movable generally parallel with said axis of movement.

19. A pressurized gas engine as in claim 18 in which said cam member is operated by the reciprocating motion of the energy transfer means associated with said cam member.

20. A pressurized gas engine as in claim 19 in which each of said pair of deformable enclosures associated with each said energy transfer means includes said supply tube and said vent tube and said first and second compression members, said cam member contacting and alternately wedging against both said first compression members and both said second compression members.

21. A pressurized gas engine as in claim 20 in which said cam member of each said valve means is connected to the associated energy transfer means by a lost motion linkage.

22. A pressurized gas engine as in claim 16 in which each said deformable enclosure includes an elastomer enclosure having a predetermined generally spheroidal shape when undistorted.

23. A pressurized gas engine as in claim 22 including a nesting support for each said deformable enclosure, each said nesting support having a concave generally spheroidal surface for supporting said deformable enclosure over a substantial peripheral portion thereof.

24. A pressurized gas engine as in claim 23 in which each said energy transfer means includes a pair of generally convex engaging portions on opposite sides along said axis of movement for engaging said deformable enclosures, each said engaging portion serving to collapse a deformable enclosure inward upon itself into said nesting support when said energy transfer means is moved against said deformable enclosure.

25. A pressurized gas engine as in claim 24 in which each said nesting support includes a passageway centrally disposed in said concave generally spheroidal surface, and in which said gas conduit connected to each said deformable enclosure extends through said passageway.

26. A pressurized gas engine as in claim 16 in which said energy transfer means are each connected to a crank arm, said crank arms being connected to a rotating member at different angular positions with respect to the rotational axis of said rotating member.

* * * * *